US006810646B1

(12) United States Patent
Sting et al.

(10) Patent No.: US 6,810,646 B1
(45) Date of Patent: Nov. 2, 2004

(54) PROCESSING STATION FOR A MAIL PROCESSING MACHINE

(75) Inventors: Martin Sting, Bad Vilbel (DE); Christian Botschek, Rodemark (DE)

(73) Assignee: Pitney Bowes Deutschland GmbH (DE)

( * ) Notice: Subject to any disclaimer, the term of this patent is extended or adjusted under 35 U.S.C. 154(b) by 0 days.

(21) Appl. No.: 09/700,529

(22) PCT Filed: Mar. 24, 2000

(86) PCT No.: PCT/EP00/02637

§ 371 (c)(1),
(2), (4) Date: Nov. 15, 2000

(87) PCT Pub. No.: WO00/58113

PCT Pub. Date: Oct. 5, 2000

(30) Foreign Application Priority Data

Mar. 25, 1999 (DE) ..... 199 13 638

(51) Int. Cl.[7] ..... B65B 43/26
(52) U.S. Cl. ..... 53/569; 198/860.3
(58) Field of Search ..... 53/284.3, 569, 53/460, 252, 381.5; 198/860.1, 860.3, 860.4, 860.5

(56) References Cited

U.S. PATENT DOCUMENTS 3,815,965 A * 6/1974 Ostwald ..... 312/100
4,020,615 A 5/1977 Irvine et al.
4,079,576 A * 3/1978 Morrison et al. ..... 53/284.3
4,627,831 A * 12/1986 Hirakawa et al. ..... 493/337
4,700,827 A * 10/1987 Haaser ..... 198/771
4,720,960 A * 1/1988 Green ..... 270/58.06
4,930,621 A * 6/1990 Brown et al. ..... 198/831
5,078,250 A * 1/1992 Cole ..... 193/35 R
5,423,418 A * 6/1995 Furrow ..... 198/860.3
5,657,529 A * 8/1997 Bohn et al. ..... 29/563
5,803,893 A * 9/1998 Armington et al. ..... 493/477
5,864,484 A * 1/1999 Harding ..... 700/127
6,289,658 B1 * 9/2001 Sting et al. ..... 53/252

FOREIGN PATENT DOCUMENTS

DE 2617189 11/1976
WO WO 99/01295 1/1999

OTHER PUBLICATIONS

Bowe Information–Und Systremtechnic GMBH, "Bowe Systemtechnik—Ihr Partner fur Informationsverarbeitung" (Bowe Systemtechnik your partner in information processing)—undated.

* cited by examiner

*Primary Examiner*—Eugene Kim
*Assistant Examiner*—John Paradiso
(74) *Attorney, Agent, or Firm*—Michael J. Cummings; Charles R. Malandra, Jr.; Angelo N. Chaclas

(57) ABSTRACT

In a processing station for a mail processing machine, a housing is formed by parallel housing side parts, standing opposite each other at a distance corresponding to the width of the conveying track of the mail processing machine, a housing part connecting these across the conveying track and a supporting partition fixed to the connecting housing part, situated in a vertical median plane relative, to the distance between the housing side parts and parallel to the housing side parts, and restricted to a prismatic or cylindrical space above a level at a distance from the surface of the conveying track. The supporting partition serves to support bearings for axles and shafts of an actuating apparatus arranged in the processing station in question, in such a manner that the space immediately above the conveying track surface is kept free of drive members and control members for the actuating apparatus in order to enable large-format inserts or sets of inserts to be passed through the processing station.

7 Claims, 1 Drawing Sheet

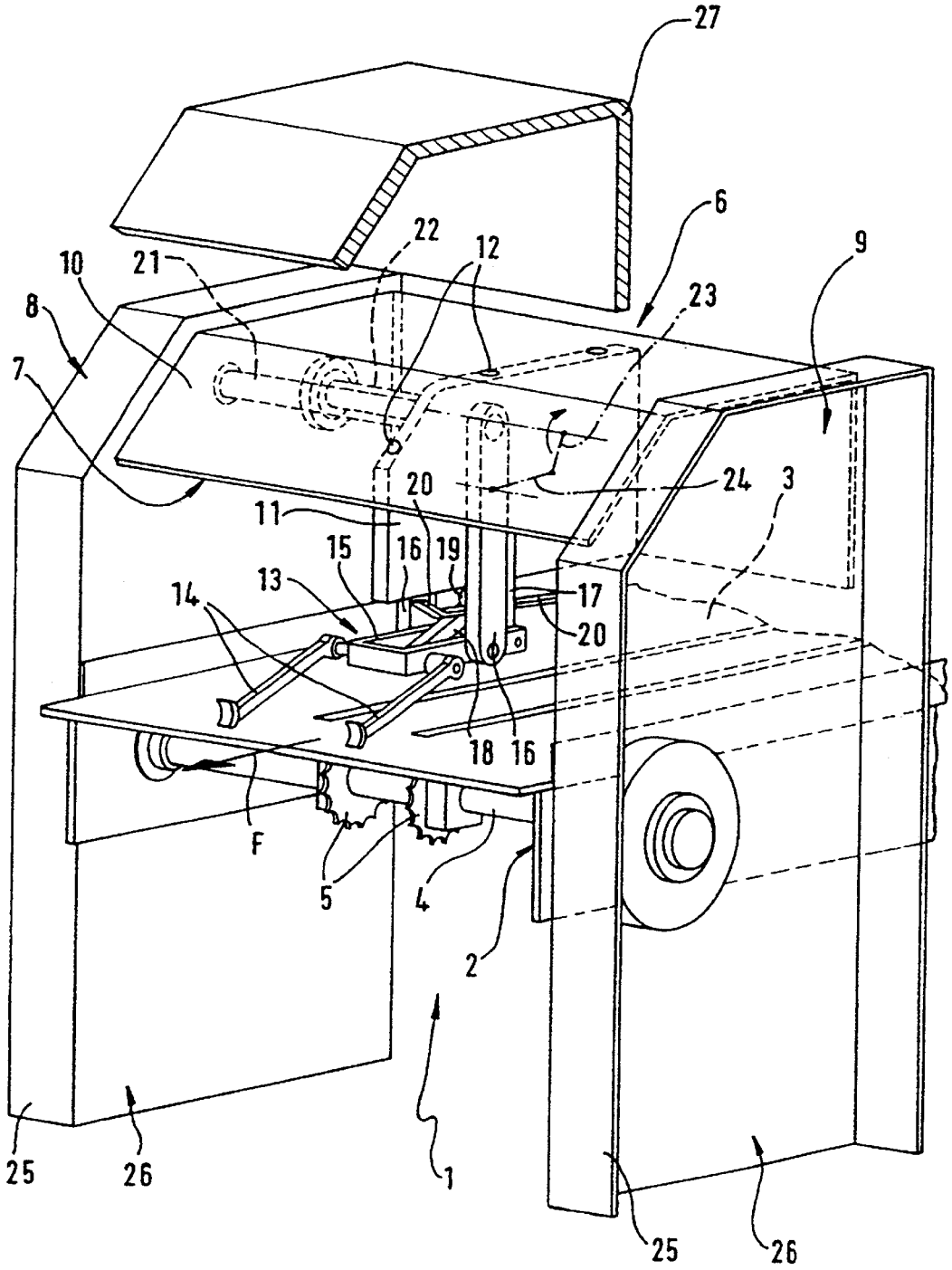
27
6
9
22
12
10
21
23
8
7
20
24
3
11
15
16
19
13
17
14
20
18
16
F
5
4
2
1
25
26
25
26

PROCESSING STATION FOR A MAIL PROCESSING MACHINE

TECHNICAL FIELD

The invention relates to a processing station for a mail processing machine having an elongate machine frame on whose surface a conveying track is located, on which the upper strand of a rotating chain conveyor arrangement forms intermittently or continuously conveyed insert compartments.

BACKGROUND ART

Processing stations of the type considered here are, for example, enveloping stations which, by means of introduction fingers moved transversely to the conveying direction of the insert compartments or in the conveying direction of the insert compartments, grip inserts or sets of inserts which are conveyed to them in the insert compartments and introduce them into letter envelopes or covers which are held open ready. Processing stations of the type considered here may also be transfer devices, which remove inserts or sets of inserts at the end of the abovementioned conveying track from a document compartment that has arrived there and pass them on to another conveying track or conveying apparatus. The brochure "BÖWE Systemtechnic—Ihr Partner für Informationsverarbeitung" BÖWE Systemtechnic—your partner in information processing number 2d 287, page 1, discloses a processing station of a mail-processing line with an elongate machine frame, on the surface of which inserts which are to be processed in insert compartments are conveyed. The housing of the processing station contains a hood space which is closed off by housing side walls which extend below the level of the surface of the machine frame, an actuating device for moving handling members being accommodated in the housing. In the known processing station, actuating elements of the actuating device extend into the hood space from a housing side wall.

In the known design, the format of the inserts, or sets of inserts, which are to be handled may be restricted in a direction transverse to the conveying direction.

The object of the invention is therefore to design a processing station of the type defined initially in such a manner that, as a result of this processing station, inserts or sets of inserts delivered by the conveying track in the insert compartments can have a format which is limited transversely to the conveying direction only by the actual width of the insert compartments of the conveying track.

This object is achieved, according to the invention, by a processing station having the features of claim 1. Advantageous embodiments and further developments form the subject of the claims dependent on claim 1, the content of which is hereby expressly incorporated as an integral part of the description without the wording being repeated at this point.

An example of embodiment is explained below with reference to the drawing.

In the single FIGURE of the drawing, a processing station of the type proposed here is shown diagrammatically and in perspective.

DETAILED DESCRIPTION OF THE INVENTION

A mail processing machine of the type considered here is generally designated by 1 in the drawing and contains an elongate machine frame 2, on the surface 3 of which a conveying track is located. Conveying fingers project above the conveying track through appropriate slits extending in the conveying direction and are fixed to rotating conveyor chains, pairs of conveying fingers lying next to each other transversely to the conveying direction defining insert compartments on the surface of the conveying track. The conveyor chains are passed around chain wheels arranged at the front end and at the rear end of the elongate machine frame 2, one chain wheel pair 5 thereof located on a shaft 4 being shown in the figure of the drawing. In the course of the rotation of the mutually parallel conveyor chains passed over the pair 5 of chain wheels, the conveying fingers fixed thereto project above the conveying track surface 3 in the region of the upper strand of the conveyor chains and transport inserts or sets of inserts introduced into the insert compartments defined by the pairs of conveying fingers along the elongate machine frame 2 to the processing station generally designated by 6 in the figure of the drawing. This processing station contains a portal-like housing, bridging the elongate machine frame 2 of the mail processing machine 1 in the direction transverse to the conveying direction of the conveying track and having a hood space 7 lying at a vertical distance above the conveying track plane or the conveying track surface 3 and closed off laterally by a housing side wall 8 and a housing side wall 9, the housing side walls 8 and 9 being orientated parallel to each other and vertically and having, in the direction transverse to the conveying direction of the conveying track, a distance apart at least equal to the width of the conveying track. The housing side walls 8 and 9 extend laterally downward below the level of the conveying track surface 3 and may also serve to provide floor support at the place of erection.

The housing side walls 8 and 9 are fixedly connected to each other by a housing part 10 which closes off at least parts of the hood space 7 at the top and, with reference to the conveying direction, at the front and at the rear. The housing part 10, which is formed by multiply folding a sheet metal strip approximately corresponding in its width to the width of the conveying track, is welded to the housing side walls 8 and 9 and imparts comparatively high strength and dimensional stability to the housing structure.

The housing additionally contains, within the prismatic hood space 7, a supporting partition 11 of substantially greater thickness by comparison with that of the housing side walls 8 and 9, it being possible for the supporting partition 11 to be produced from an aluminum plate which, as indicated at 12, is screw-fixed to the housing part 10 and abuts against the housing part 10. The supporting partition 11 lies parallel to and between the housing side walls 8, 9, approximately centrally with regard to the distance between the housing side walls 8 and 9, transversely to the conveying direction. The supporting partition 11 serves to support and mount bearings for axles and shafts of an actuating apparatus 13 arranged in the processing station 6. The actuating apparatus 13 has, as handling members of the processing station in question, introduction fingers 14 which can be reciprocally moved, for movement within the space between the hood space 7 and the conveying track surface 3, at a level below the lower edge of the supporting partition 11.

The introduction fingers 14 are lowered onto the conveying track surface 3 by their outer ends in the direction of the arrow F indicated in the drawing, during one working stroke, and have the function of gripping a set of inserts in an insert compartment, delivered by the conveying fingers of the conveyor chains, at an edge extending transversely to the conveying direction in accordance with the arrow F and passing them for further processing, for example introducing them into covers or envelopes held open ready. In this case, the processing station 6 is an enveloping station. The actuating apparatus 13 contains, in the embodiment shown in the drawing, a carrier hand 15 in the form of a U-shaped part open toward the conveying direction in accordance with the arrow F. Mounted on the front end of the carrier hand 15 is an insertion finger shaft extending transversely to the conveying direction, to whose outer ends the introduction fingers 14 are fixed. By spring means (not shown) which surround the introduction finger shaft and are effective between the carrier hand 15 and the introduction fingers 14, the introduction fingers 14 are prestressed into a lowered position in which the outer ends of the introduction fingers 14 essentially rest on the conveying track surface 3. The carrier hand 15 is connected in an articulated manner to a pair of drive levers 16, which are connected in the middle region of the carrier hand 15, and to a connecting rod 17 which is connected in an articulated manner to a backward-extended leg of the carrier hand 15. The drive levers 16 and the connecting rod 17 extend upward to bearing points supported by the carrier partition 11 and solid with the frame, the respective lengths of the drive levers 16 and the connecting rod 17 and the distance between the articulation points of the levers and connecting rods on the carrier hand 15 and on the carrier partition 11 being so selected that the carrier hand 15, the drive lever 16 and the connecting rod 17 form a three-connecting-rod straight-line transmission whereby, by horizontal swinging of the drive levers 16, the introduction finger shaft is reciprocally moved substantially in a horizontal plane parallel to the guide track surface 3 in the direction of the arrow F and counter thereto.

The lowering of the introduction fingers 14 for the working stroke and the raising of the introduction fingers 14 for the return stroke during the reciprocal movement of the carrier hand 15 are performed by a link control. To this end, a link sensor lever 18 is fixed on the introduction finger shaft and has a link sensor roller 19 mounted on its free end. This link sensor roller 19 senses, during the working stroke, the lower edge of the supporting partition 11 which forms a fixed part of the link. During the return stroke, the link sensor roller 19 runs on a switching link part 20 mounted on the supporting partition 11 to be capable of horizontal swinging, and capable of horizontal swinging, in the manner of points, under the contact force of the link sensor roller 19 approximately in the plane of the supporting partition 11 so that, at the beginning of the return stroke, the link sensor roller 19 makes a comparatively gentle transition from the fixed link part to the switched link part and, at the beginning of the working stroke, can with a comparatively gentle transmission take the path on the fixed link part.

The drive levers 16 are fixed on a pivot pin 21 which is mounted at one end by a bearing provided in the supporting partition 11 and at the other end by a bearing provided in the housing side wall 8.

Additional bearings for supporting a crank shaft 22 are additionally located in the supporting partition 11 and the housing side wall 8 at a predetermined distance from the two abovementioned bearings. A crank 23 is fixed on an end of the crank shaft 22 projecting above the bearing point of the supporting partition 11 and is only indicated diagrammatically, in broken lines, in the drawing. From the end of the crank 23, a driving rod 24 (likewise shown only diagrammatically) extends to an articulation point on the drive lever 16 lying closer to the observer of the drawing. When the crank shaft 22 is set: to rotate by drive means (not shown in the drawing), pivot movements are imparted to the drive levers 16 via the crank 23 and the driving rod 24.

As is apparent, the housing design indicated here makes it possible to arrange drive members, control mechanisms, bearing points and the like for an actuating apparatus of the processing station 6 above a space extending in the direction of the conveying track and over the entire width thereof, into which space only the introduction fingers 14 penetrate during the working stroke. The result achieved hereby is that inserts or sets of inserts are conveyed over the conveying track 3 whose transverse format is not restricted by drive members or control members for the actuating apparatus during any phase of operation.

It is apparent from the drawing that the housing side parts 8 and 9 have edge flanges 25 which are formed by folding of the sheet metal blanks used to produce the housing side parts. The edge flanges 25 circumscribe laterally open external housing areas 26, in which drive members for the drive of the crank shaft 22 and/or drive members for the drive of the chain wheels 5 for the conveyor chains are accommodated. The external housing parts may be closed off by housing covers.

It is furthermore apparent from the drawing that the multiply folded housing part 10 which limits the prismatic hood space 7 at the top is not directly positioned to end flush with the housing side parts 8 and 9 at the top, but is fixed to the housing side parts 8, 9 somewhat below their upper edge. In the space thus formed above the housing part 10 and between the housing side parts 8 and 9, a sound absorption hood 27 is introduced which is adapted to the design of the housing part 10 and can be sufficiently thick to produce a flush abutment against the upper edge of the housing side parts 8 and 9 after the insertion of the sound absorption hood 27.

What is claimed is:

1. A processing station (6) for a mail processing machine (1) having a elongate machine frame (2)—having a surface (3) where a conveying track is located, on which the upper strand of a rotating chain conveyor arrangement forms intermittently or continuously conveyed insert compartments, the processing station (6) possessing a housing (8, 9, 10) having a hood space (7) which lies above the plane of the conveying track and is closed off laterally by housing side walls (8,9) the housing side walls separated by a distance at least equal to the width of the conveying track having walls that extend below the conveying track on both sides thereof, and also possessing an actuating device (13) which is located in the housing (8,9,10) and is intended for moving handling members (14), wherein the hood space (7), which lies above the plane of the conveying track at a vertical distance, has a prismatic or cylindrical cross section as seen in the horizontal direction and in the direction transverse to the conveying direction, in that the housing contains a supporting partition (11) which is of substantially greater thickness by comparison with the housing side walls (8,9), is fixed parallel to the housing side walls (8, 9) midway between the latter in the hood space (7), and carries bearings for axles (21) and shafts (22) of the actuating (13), the supporting partition (11) supporting the actuating device (13) which is arranged in the processing station (6) and whose handling members (14) can be moved in the space between the lower edge of the supporting partition (11) and the surface (3) of the machine frame (2).

2. The processing station as claimed in claim 1, wherein the housing side walls (8,9) are fixedly connected to each other by a housing part (10) which closes off at least some areas of the hood space (7) upward and, relative to the conveying direction (F), to the front and rear, and in that the supporting partition (11) is fixed to this housing part.

3. The processing station as claimed in claim 1, wherein the housing side walls (8,9) bear edge flanges (25) at least along some of their edges which each point away from the hood space (7) in such a manner that, on the sides remote from the conveying track, laterally open receiving chambers (26), which can be closed in particular by cover plates, are formed for the drive mechanism of the actuating apparatus (13) and/or the drive mechanism of the chain conveyor arrangement.

4. The processing station as claimed in claim 2, wherein the housing part (10) closing off at least parts of the hood space (7) is connected to the housing side walls (8, 9), and offset inward relative to the outer edge thereof, in such a manner that a sound-absorbing cladding or cladding shell (27) can be introduced into the flat space formed between the housing side walls (8, 9) and said housing part (10).

5. The processing station as claimed in claim 1, wherein it is an enveloping station and in that an enveloping station base plate is fixed between the housing side walls (8, 9) and adjoins the conveying track and is flush therewith.

6. The processing station as claimed in claim 1, wherein shafts and/or axles of the actuating apparatus (13) are also supported on bearings held by the housing side walls (8, 9).

7. The processing station as claimed in claim 1, wherein the actuating apparatus (13) possesses a carrier hand (15) bearing handling members, in particular insert introduction fingers (14) and is coupled to the axles (21) mounted on the supporting partition (11) via connecting rods (17) and drive levers (16) of different lengths in such a manner that, in the event of a horizontal swing of the connecting rods (17) or drive levers (16), at least the point of connection of the handling members on the carrier hand (15) is reciprocally moved substantially horizontally in the conveying direction, above the surface (3) of the machine frame (2), at least one pair of connecting rods (17) or drive levers (16) of the same length being provided, one of which being arranged on one side and the other on the other side of the supporting partition (11) and being connected to the carrier hand (15).

* * * * *